US006276028B1

(12) United States Patent
Pinto

(10) Patent No.: US 6,276,028 B1
(45) Date of Patent: Aug. 21, 2001

(54) NON-WOVEN FABRIC FORMING SYSTEM

(76) Inventor: Akiva Pinto, P.O. Box 1100-171, Gastonia, NC (US) 28053-1100

( * ) Notice: Subject to any disclaimer, the term of this patent is extended or adjusted under 35 U.S.C. 154(b) by 0 days.

(21) Appl. No.: 09/760,925

(22) Filed: Jan. 16, 2001

Related U.S. Application Data

(63) Continuation-in-part of application No. 09/505,922, filed on Feb. 17, 2000.

(51) Int. Cl.[7] ..... D01G 15/40

(52) U.S. Cl. ..... 19/105; 19/65 A; 19/145.5; 19/145.7; 19/200

(58) Field of Search ..... 19/98, 65 A, 105, 19/106 R, 97.5, 145.5, 145.7, 161.1, 200, 203, 204, 205, 296, 300, 302, 303, 304

(56) References Cited

U.S. PATENT DOCUMENTS

| | | | | |
|---|---|---|---|---|
| 4,045,091 | * | 8/1977 | Beneke | 19/105 |
| 4,154,485 | * | 5/1979 | Lytton et al. | 19/105 |
| 4,240,180 | | 12/1980 | Wood et al. | 19/105 |
| 4,387,486 | | 6/1983 | Keller et al. | 19/105 |
| 4,657,444 | | 4/1987 | Pinto | 406/23 |
| 4,682,388 | | 7/1987 | Pinto | 19/105 |
| 4,694,538 | | 9/1987 | Pinto et al. | 19/105 |
| 4,700,431 | | 10/1987 | Artzt et al. | 19/105 |
| 4,858,277 | | 8/1989 | Pinto et al. | 19/200 |
| 5,156,743 | | 10/1992 | Munerief | 210/671 |
| 5,253,392 | * | 10/1993 | Ripley | 19/105 |
| 5,303,455 | * | 4/1994 | Leifeld | 19/200 |
| 5,343,597 | | 9/1994 | Pinto et al. | 19/205 |
| 5,950,282 | | 9/1999 | Pinto | 19/97.5 |

* cited by examiner

*Primary Examiner*—John J. Calvert
*Assistant Examiner*—Gary L. Welch
(74) *Attorney, Agent, or Firm*—Flint & Kim, P.A.

(57) ABSTRACT

A system for forming a non-woven fabric with high resilience and high loft in a continuous process comprising first and second carding systems arranged in parallel carding fibers from a first and second fiber supply, a doffer associated with each carding system for removing the carded fibers, a transport associated with each doffer for transporting the carded and doffed fibers to a pair of independent blending and feed chutes. A housing associated with the blending and feed chutes receiving the carded and blended fibers for further blending, and a feed roll within the housing and adjacent discharge end of each blending and feed chute for withdrawing the fibers delivering them into the housing for further opening and blending. A beater roll removing the further opened and blended fibers from the housing into a chute for forming non-woven fabrics. Here the fibers are compacted into a non-woven fabric having high loft and resilience.

19 Claims, 4 Drawing Sheets

NON-WOVEN FABRIC FORMING SYSTEM

This is a continuation-in-part of my earlier filed application with Ser. No. 09/505,922 filed on Feb. 17, 2000.

BACKGROUND OF THE INVENTION

The instant invention is directed to a system for forming fabric webs or non-woven fabrics of evenly and throughly blended fibers.

Fabric webs or non-woven fabrics are well known throughout the textile industry. Normally, these webs or batts are formed by producing carded or air lay webs and passing a plurality of these webs through a cross-lapper to produce the fiber web of sufficient height with entangled fibers for web unity. A major drawback to this system is that the fiber directions are generally in line with the direction of carding thus placing the fibers of the stacked or lapped webs in X,Y positions. This results in a web which has a tendency to separate.

Another problem with this type of system is that production is limited to the speed of the cross-lapping machine.

It is the object of the instant invention to provide a system capable of producing a fabric web or non-woven fabric in which the fibers are disposed in all directions thus forming a more stable fabric or web.

Another object of the invention is a system capable of producing non-woven fabrics or fabric webs at increased speeds.

Another object of the invention is a system for producing non-woven fabrics or webs of selectively variable widths.

Another object of the invention is to provide a system for producing non-woven fabrics or webs without a cross-lapper.

Another object of the invention is to provide a system for the production of non-woven webs or fabrics structured with sufficient stability, loft, and resilience to be used as pillow stuffing, upholstery padding, mattress stuffing and other similar products.

SUMMARY OF THE INVENTION

The invention is directed to a non-woven fabric or web with high resilience and high loft which operates with increased productivity and quality. It comprises a first and second carding system which is arranged in parallel and which card fibers from separate first and second fiber supplies. A doffer is associated with each carding system for removing the carded fibers therefrom. A transport is connected with each doffer and acts to transport the carded and doffed fibers into independent blending and feed chutes.

A housing is provided to receive the carded and blended fibers from the feed chutes for further blending. A feed roll is located within the housing and adjacent the discharge ends of each of the blending and feed chute for withdrawing the fibers from the blending and feed chutes and delivering them into the housing for further opening and blending. A beater roll is provided for removing the further opened and blended fibers from the housing into a non-woven fabric forming chute. Here the fibers are compacted and intertangled into a non-woven fabric of desired high fiber loft and high resilience.

The first and second carding systems may each comprise between one and four carding machines. When there is more than one machine per system, they may be arranged in tandem or in series.

There may be a reserve fiber supply unit located between the carding machines and the blending and feed chutes. In this arrangement the transport comprises first and second units, the first unit connecting the carding machine output with the reserve fiber supply and the second unit connecting the reserve fiber supply unit with the blending and feed chutes.

The doffers may be air doffers or roll doffers and the transport may be air transport or conveyor belt transport.

The feed roll of the system comprises first and second feed rolls, one adjacent each discharge end of the blending and feed chutes. Each of the rolls are driven at selected RPMs which allow the fibers from each of the blending and feed chutes to be delivered into the housing in selected volumes. This is an individual electric motor for driving the beater roll and the first and second feed rolls are each driven by independent motors wherein RPMs for each may be independently adjusted.

The non-woven fabric forming chute includes a packing belt along one surface thereof and a vibrator plate along a second surface opposite said one surface which work together to compact the fibers therein into a non-woven fabric of high resilience.

A system for forming a non-woven fabric with high resilience and high loft comprising in a continuous operation. The system includes first and second carding machines arranged in parallel and carding fibers delivered from a first and second fiber supply.

A first and second doffer may be associated with each carding machine for removing carded fibers therefrom. A first transport is associated with each first doffer for transporting the carded and doffed fibers to a respective intermediate reserve supply chamber. A second transport is associated with each second doffer for transporting the carded or doffed fibers to the respective intermediate reserve supply chamber. A third transport is associated with each intermediate reserve supply chamber and a blending and feed chute for transporting the carded and doffed fibers to respective of the blending and feed chute.

A housing receives the carded and blended fibers from the feed chutes for further blending of the fibers and for delivery to a fiber web forming chute where the fibers are formed into a non-woven fabric or web with high loft and great resilience.

DESCRIPTION OF THE DRAWINGS

The invention will be more readily understood from a reading of the following specification and by reference to the accompanying drawings forming a part thereof, wherein an example of the invention is shown and wherein.

DESCRIPTION OF THE PREFERRED EMBODIMENT

Figure 1:
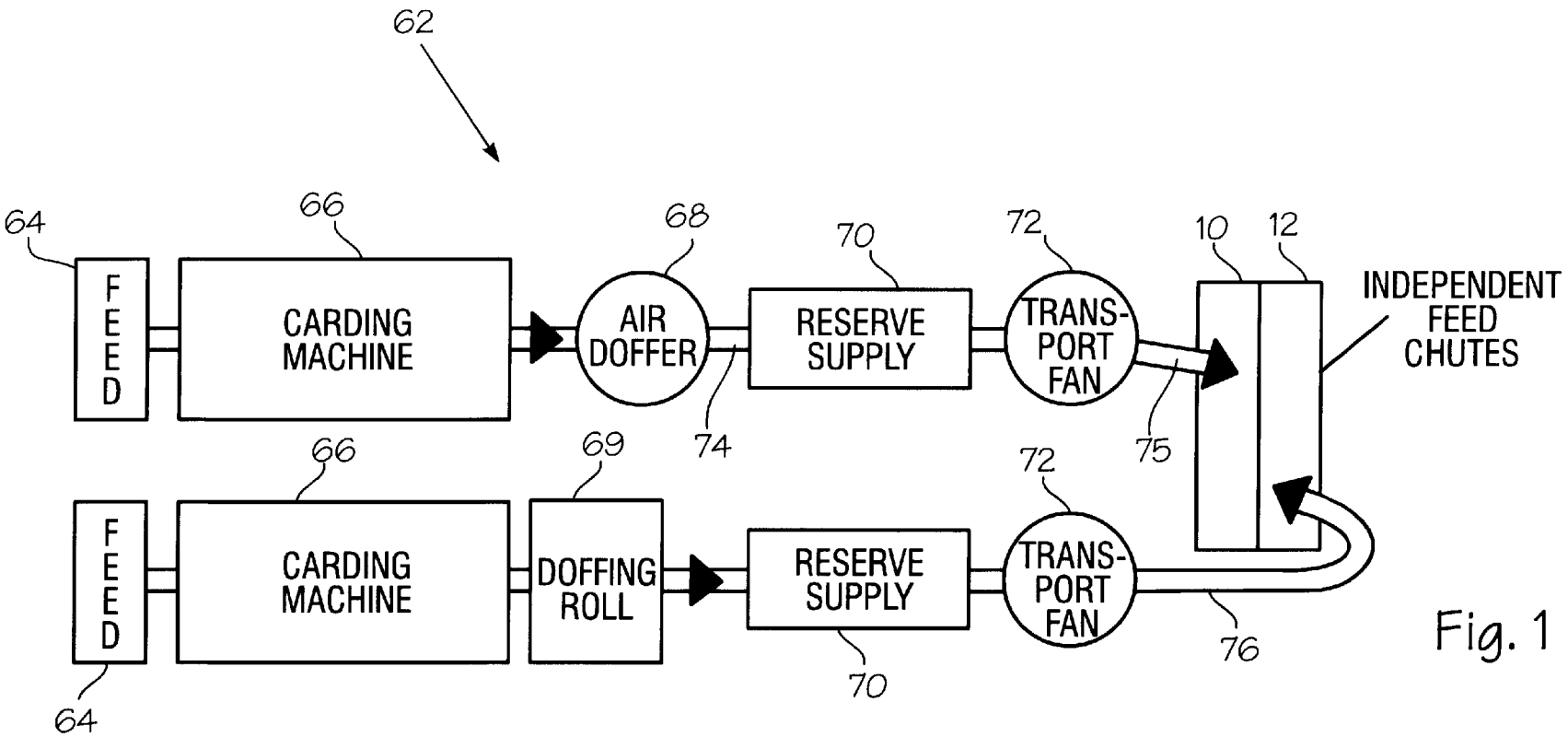
FIG. 1 is a diagrammatic view of a first arrangement of the system of the invention.

Turning now to the drawings, FIG. 1 shows a first arrangement 62 of the system for transforming fibers into a non-woven web or fabric. The system begins with a fiber feed system which comprises a pair of fibers feeders 64 which supply fibers to a pair of carding machines 66. Carding machines 66 which may be any known type of carding machine, are arranged side by side or in parallel. The fibers fed through each machine are maintained separated during this phase of the operation. It is noted that other types of fiber opening apparatus, such as air lay openers, may be substituted for the carding machines.

Doffers, such as roll doffers 69, or air doffers 68, are connected with doffing machines 66 and withdraw the carded fibers from the carding roll and deposit them onto transport 74. It is noted that it is preferred both doffers be of the same type, however, this is not necessary.

Transports 74 deliver the carded and doffed fibers into a reserve supply 70 which acts to further blend the fibers and also to provide a constant supply of fibers for the next phase of the operation.

Transports 75 and 76 are connected with the reserve supplies 70 and act to transport the fibers to respective feed chutes 10, 12.

Transports 74 and 75, 76 may be in the form of conveyor belts or they may be in the form of air ducts. Fans 72 may be provided to generate the air current to carry the fibers through the transports.

Figure 4:
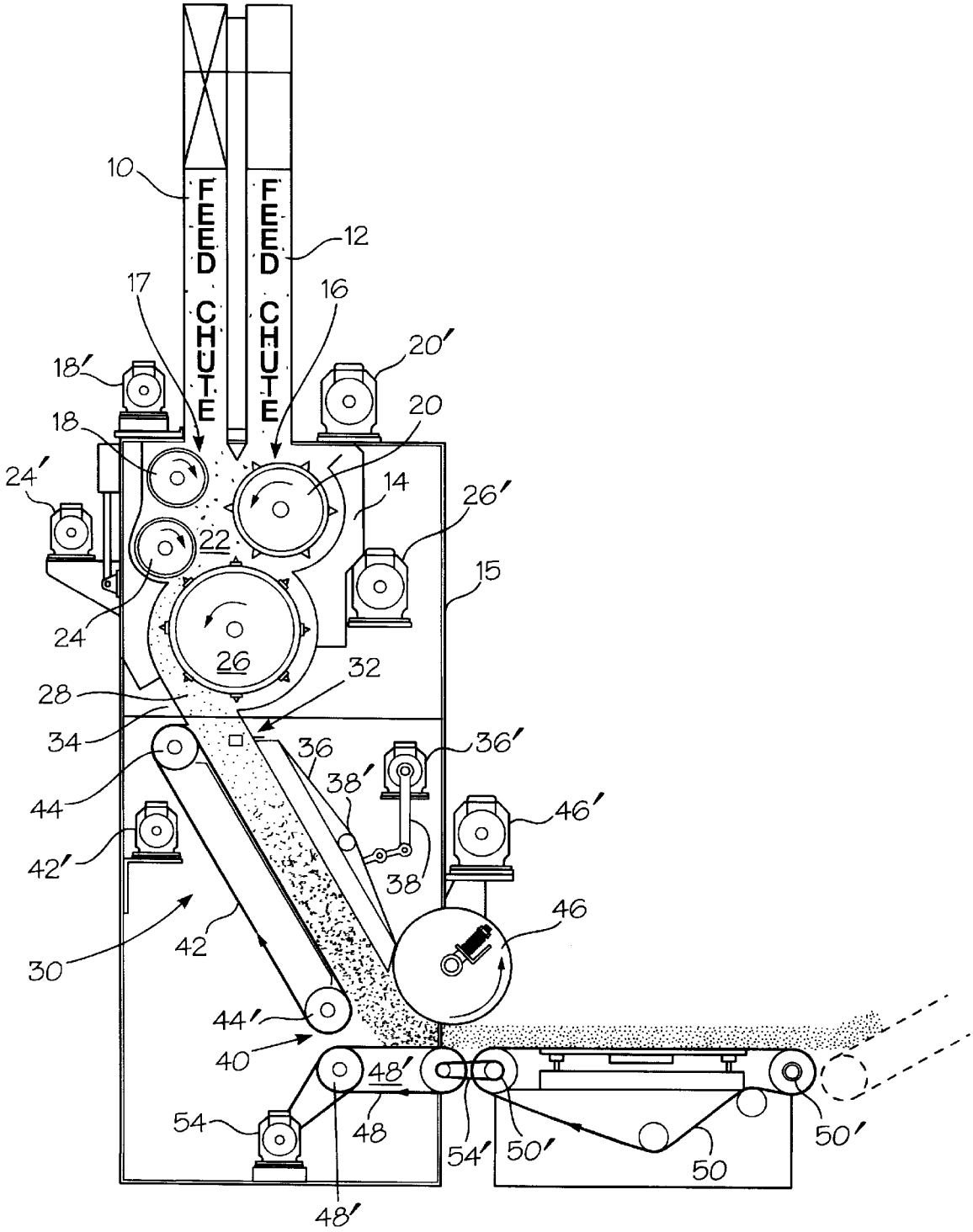

Feed chutes 10,12, as shown in FIG. 4, are connected with housing 14 which is formed within a cabinet 15.

Fiber discharge openings 16, 17 are arranged in the upper surface of housing 14 as shown in FIG. 4. Feed roll 18 is located adjacent opening 17 and rotates in a clockwise direction. Feed roll 20 is located adjacent opening 16 and rotates in a counter clockwise direction. Preferably, the diameter of feed roll 18, which is about 6 inches in diameter, is about half the diameter of feed roll 20.

Feed rolls 18 and 20 are driven by independent drive motors 18', 20' which are each controlled to selectively drive the feed rolls at selected RPM's. The speed selected is determined by sensors, to be discussed further on, which usually control feed rolls 18 and 20 to have the same peripheral speed. A median peripheral speed for feed rolls 18 and 20 is between 0 and 20 m/min. In cases where the mixture of fibers from chutes 10 and 12 is to be unequal, the peripheral speed between rollers 18 and 20 is adjusted to obtain the desired mixture.

The feed rolls deliver the fibers into mixing chamber 22 where they are further opened and blended. At the lower end of mixing chamber 22 there is located a combing roll 24 and a beater roll 26. Combing roll 24 along with feed roll 20 act to pick up fibers in the mixing chamber and wipe them onto the outer surface of the beater roll. The beater roll in turn acts to further open and blend the fibers as they are moved through the beater chamber during delivery into receiving end 28 of batt chute 30.

Comber roll 24 and beater roll 26 are driven by motors 24' and 26' at selected speeds.

The peripheral surfaces of feed rolls 18, 20, of comber roll 24 and of beater roll 26 are formed of pin like members of usual construction. Normally, the pins are arranged in parallel transverse rows, however in the case of at least feed roll 20, it has been found to be desirable to arrange the pin rows in a helical pattern. Such a pattern of teeth acts to more evenly wipe the fibers onto beater roll 26.

Forming chute 30 is of usual rectangular shape with an upper wall 32 and a lower wall 34 spaced by a pair of equal sized sides. Upper wall 32 includes a vibrating plate 36. Vibrating plate 36 extends across the width of upper wall 32 and lengthwise of forming chute 30 from adjacent the upper end of wall 32 to the end of forming chute 30. Vibrating plate 36 forms the upper surface of discharge or delivery end 40 of the batt forming chute. Vibrating plate 36 is driven in a rocking motion about pivot 38' by motor 36' through linkage 38. The structure of chute 30 maintains vibrating plate 36 in a substantially fixed positioned relative to lower wall 34. Vibrating plate 36 acts to assist in the flow or movement of fibers fed through receiving end 28 toward and through delivery end 40.

Lower wall 34 carries packing belt 42 which extends over substantially its entire area. Packing belt 42 which is continuous, passes around roller 44 which is arranged near the upper end of lower wall 34 and around the roller 44' which is arranged at delivery end 40 of the batt forming chute. Motor 42' drives roller 44 and packing belt 42 in a clockwise direction. The packing belt acts to physically assist the movement of the fibers, which until this point are fed by gravity, down the forming chute forming the fiber web or non-woven fabric fibers which are more evenly blended in the lower portion of the batt forming chute.

Compression roll 46, which is driven by motor 46', acts to compress and draw the formed fiber batt out of delivery end 40 of the batt forming chute.

It is the combined operations of vibrating plate 36 and packing belt 42 which draw and urge sufficient quantities of fibers toward delivery end 40 and compressor roll 40 forms a web of sufficient density and fibers entangled to produce a non-woven fabric or fiber web of substantial body.

A conveyor belt 48, arranged adjacent delivery end 40 receives the fiber batt emerging from the delivery end. Conveyor belt 48, which passes around rollers 48', acts as a back wall against which compression roll 46 further compresses the fiber web or non-woven fabric and further acts as a delivery belt for moving the formed fiber web onto conveyor belt 50.

Conveyor belt 50 passes about rollers 50'. Motor 54 which is connected with a roller 48' also drives conveyor belt 50 through drive belt 54'.

Mounted intermediate rollers 50' is a scale which acts to weigh the fiber batt emerging from delivery end 40 as it is moved over conveyor belt 50. The weight of the formed fiber web or non-woven fabric is sent to a control which calculates its density and compares this density to a norm as fully described in co-pending application with Ser. No. 09/505, 922.

Figure 2:
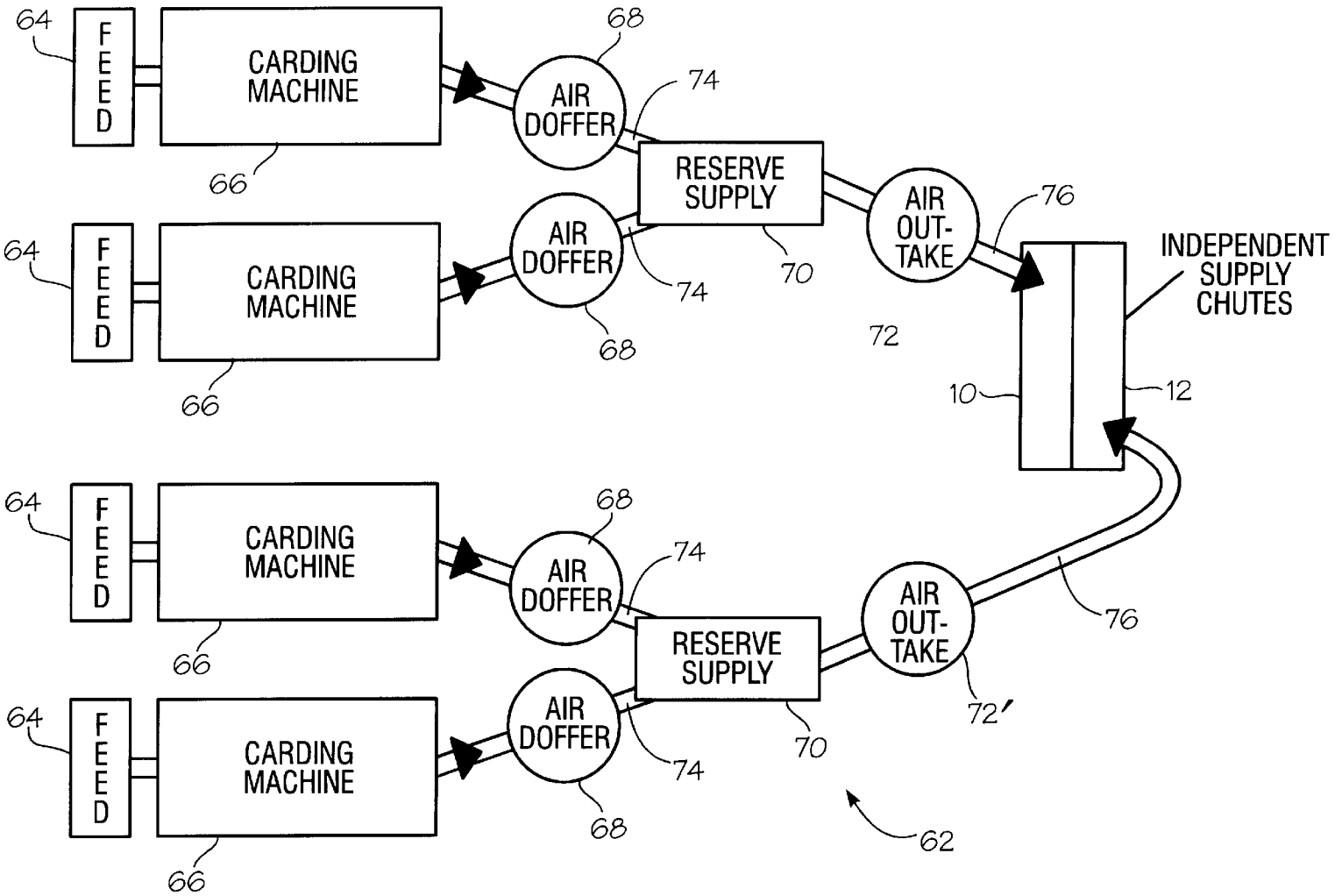
FIG. 2 is a diagrammatic view of a second arrangement of the system of the invention which utilizes a greater number of carding machines.

Turning now to FIG. 2, a second arrangement of the system identified as 62' is shown. Here, there are two pair of carding machines 66, arranged in parallel. Each pair of carding machines 66, in an alternative arrangement 62''' could be arranged in tandem or one behind the other if desired.

As in the arrangement shown in FIG. 1, doffer 68 draws the carded fibers off the carding roll of the carding machines and transports 74 move the fibers into reserve supplies 70. Doffers 68 may be air doffers or roll doffers. Again, transports 75, 76 deliver the stored and blended carded fibers into respective independent feed chutes 10 and 12. The transports may be belt conveyors or air chutes.

Figure 3:
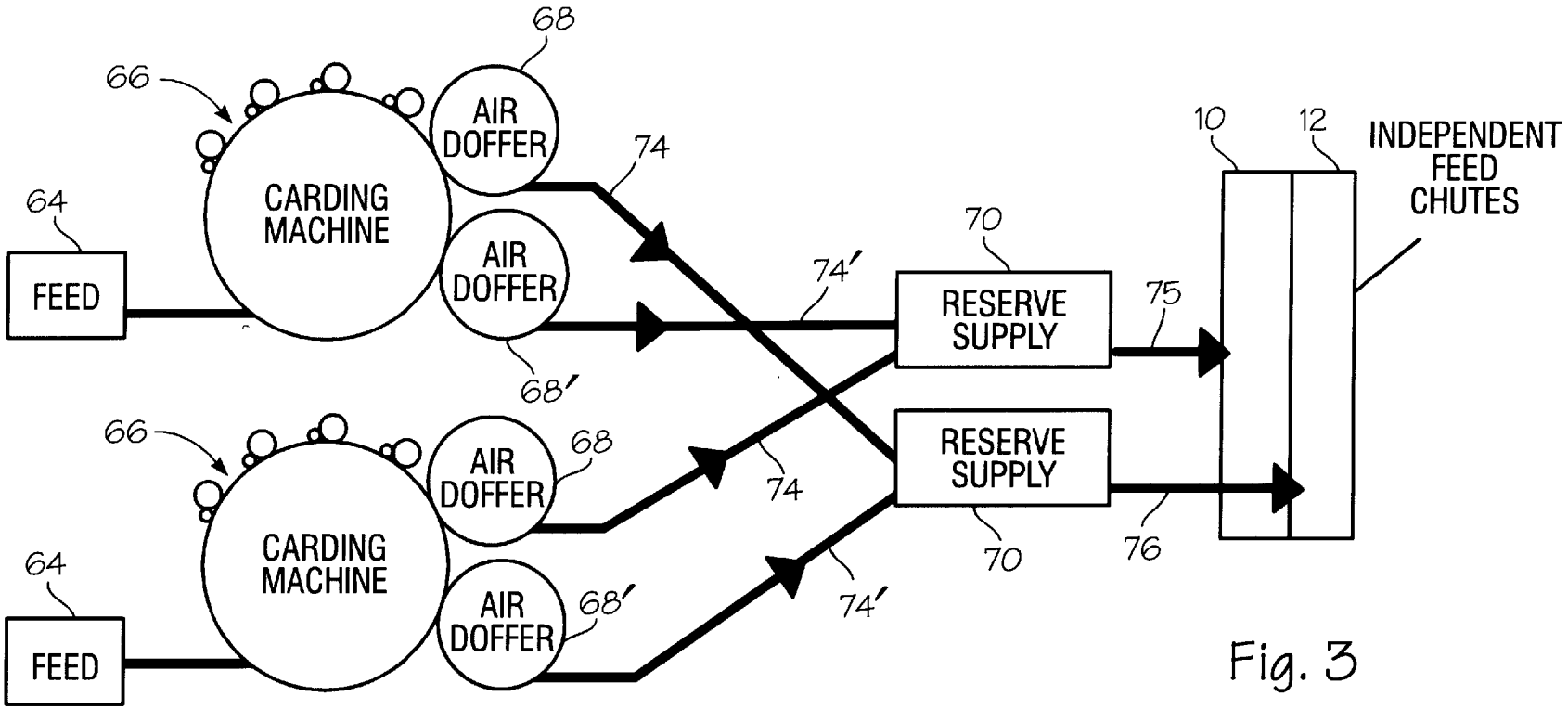
FIG. 3 is a diagrammatic view of a third arrangement of the invention in which a plurality of doffers are used with each carding machine; and, FIG. 4 is a broken-away side view of the non-woven web or fabric forming machine of the invention.

A third arrangement is shown in FIG. 3. Here, carding machines 66 are fed fibers through feeds 64 as in the earlier arrangements. In this third arrangement each carding roll has a pair of doffers 68, 68' arranged in sequence to remove the carded fibers.

Doffer 68 engages the carded fibers first removing the majority of the fibers and the longer fibers. Doffer 68' removes the remainder of and shorter fibers from the carding roll. Again, the doffers may be air or roll doffers.

As shown first doffers 68 are associated with transports 74 which deliver the doffed fibers to respective of reserve supplies 70. Transports 74' which are associated with doffers 68' deliver the doffed fibers to opposite ones reserve supplies 70. In this manner, fibers from each carding machine are delivered to each of the reserve supplies 70.

Transports 75, 76 are associated with reserve supplies and independent feed chutes as previously described.

It is noted that reserve supplies 70 may be eliminated and the fibers delivered directly from the carding machines to the independent supplies.

Independent supplies 10 and 12 of FIGS. 2 and 3 supply housing 14 shown in FIG. 4 and the fibers are processed through the fiber web or non-woven fabrics forming machine in the manner already set forth.

It is to be understood that independent feed chutes 10, 12 shown in FIGS. 2 and 3 are also associated with the fiber web or non-woven fabric forming apparatus shown in FIG. 4. Also, it is to be understood that alternative opening apparatus may be used with the arrangements shown in FIGS. 2 and 3.

The arrangements described above are capable of providing a supply of carded and blended fibers to the fiber web or non-woven fabric forming machine at an increased rate which allows increased production of the non-woven web. The fibers are more evenly blended and the fiber directions are disoriented in all directions providing for a more stable and more resilient product. Also, non-woven webs of up to seven meters wide are capable of being produced with the disclosed system.

The system is ideal for preparing fibers which are all natural, all synthetic, or blends of natural and synthetic. Also, the fibers may be virgin fibers or regenerated fibers.

While a preferred embodiment of the invention has been described using specific terms, such description is for illustrative purposes only, and it is to be understood that changes and variations may be made without departing from the spirit or scope of the following claims.

What is claimed is:

1. A system for forming a non-woven fabric with high resilience and high loft comprising:

first and second carding systems arranged in parallel carding fibers from a first and second fiber supply;

a doffer associated with each said carding system for removing said carded fibers;

a transport associated with each said doffer for transporting said carded and doffed fibers to independent blending and feed chutes;

a housing receiving said carded and blended fibers from said feed chutes for further blending;

a feed roll within said housing and adjacent discharge ends of each said blending and feed chute for withdrawing said fibers from said blending and feed chutes and delivering them into said housing for further opening and blending;

a beater roll for removing said further opened and blended fibers from said housing into a non-woven fabric forming chute; wherein, said non-woven fabric forming chute forms said fibers into a non-woven fabric comprising a high loft fiber web with high resilience.

2. The system of claim 1 wherein each said first and second carding system comprises between one and four carding machines.

3. The system of claim 2 wherein between two and four carding machines of said between one and four carding machines of each said first and second carding system are arranged in tandem.

4. The system of claim 2 wherein between two and four carding machines of said between one and four carding machines of said first and second carding systems are arranged in series.

5. The system of claim 1 wherein each said transport comprises first and second transport units each said first transport unit interconnecting with a reserve supply unit which receives said carded fibers.

6. The system of claim 5 wherein each said second transport units of said transport interconnect between a respective of said reserve supply unit and a respective of said feed chutes.

7. The system of claim 1 wherein said doffers are roll doffers.

8. The system of claim 1 wherein said doffers are air doffers.

9. The system of claim 1 wherein said transport is an air transport.

10. The system of claim 1 wherein said transport is a conveyor belt transport.

11. The system of claim 1 wherein said feed roll comprises first and second feed rolls, one adjacent each discharge and of said feed chutes, said first and second feed rolls being driven at selected RPMs wherein fibers from each of said blending and feed chutes may be delivered to said housing in selected volumes.

12. The system of claim 11 wherein said beater roll and said first and second feed rolls are each driven by independent motors wherein RPMs for each may be independently adjusted.

13. The system of claim 1 wherein said non-woven fabric forming chute includes a packing belt along one surface thereof and a vibrator plate along a second surface opposite said one surface; whereby, said fibers may be compacted into a non-woven fabric of high resilience.

14. A system for forming a non-woven fabric with high resilience and high loft comprising:

first and second carding systems arranged in parallel carding fibers from a first and second fiber supply;

a doffer associated with each said carding system for removing said carded fibers;

a first transport associated with each said doffer for transporting said carded and doffed fibers to a respective intermediate reserve supply chamber;

a second transport associated with each said intermediate reserve supply chamber and a blending and feed chute for transporting said carded and doffed fibers to said blending and feed chute;

a housing receiving said carded and blended fibers from said feed chutes for further blending;

a feed roll within said housing and adjacent discharge ends of each said blending and feed chute for withdrawing said fibers from said blending and feed chutes and delivering them into said housing for further opening and blending;

a beater roll for removing said further opened and blended fibers from said housing into a non-woven fabric forming chute; wherein, said non-woven fabric forming chute forms said fibers into a non-woven fabric comprised of a high loft fiber web with high resilience.

15. A system for forming a non-woven fabric with high resilience and high loft comprising:

first and second carding systems arranged in parallel carding fibers from a first and second fiber supply;

a plurality of doffers associated with each said carding system for removing said carded fibers;

a first transport associated with each of first ones of said doffers for transporting said carded and doffed fibers to a respective first and second intermediate reserve supply chamber;

a second transport associated with each of second ones of said doffers for transporting said carded and doffed fibers to a respective of said first and second intermediate reserve supply chambers, wherein doffed fibers from each said carding system is transported into each of said first and second intermediate reserve supply chambers;

a third transport associated with each said intermediate reserve supply chamber and a respective blending and feed chute for transporting said carded, doffed, and blended fibers to said respective blending and feed chute;

a housing receiving said carded, doffed, and blended fibers from said blending and feed chutes for further opening and blending;

a feed roll within said housing adjacent discharge ends of each said blending and feed chute for withdrawing said fibers from said blending and feed chutes and delivering them into said housing for further opening and blending;

a beater roll for removing said further opened and blended fibers from said housing into a non-woven fabric forming chute; wherein, said non-woven fabric forming chute forms said carded and blended fibers into a non-woven fabric comprised of a high loft fabric web with high resilience.

16. The system of claim 15 wherein each said first and second carding system comprises between one and four carding machines.

17. The system of claim 15 wherein said plurality of doffers comprises two.

18. The system of claim 15 wherein said plurality of doffers are one of roll doffers and air doffers.

19. The system of claim 15 wherein said first, second, and third transports comprise one of air transports or conveyor transports.

* * * * *